United States Patent [19]

Fukuta et al.

[11] Patent Number: 5,070,914

[45] Date of Patent: Dec. 10, 1991

[54] TRIAXIAL FABRIC OF INTERLACED OBLIQUE YARNS

[75] Inventors: Kenji Fukuta, Tsukuba; Hiroshi Hatta; Noboru Hiroshima, both of Sagamihara; Kunihiko Murayama, Amagasaki; Toshiyuki Sugano, Sagamihara, all of Japan

[73] Assignees: Mitsubishi Denki Kabushiki Kaisha; Agency of Industrial Science and Technology, both of Tokyo, Japan

[21] Appl. No.: 485,834

[22] Filed: Feb. 28, 1990

Related U.S. Application Data

[63] Continuation of Ser. No. 278,210, Nov. 30, 1988, abandoned.

[30] Foreign Application Priority Data

Nov. 30, 1987 [JP] Japan ..... 62-302910

[51] Int. Cl.[5] ..... D03D 13/00

[52] U.S. Cl. ..... 139/384 R; 139/11; 139/457; 139/DIG. 1; 87/8; 87/33

[58] Field of Search ..... 139/457, 459, 384 R, 139/11

[56] References Cited

U.S. PATENT DOCUMENTS

| | | | |
|---|---|---|---|
| 4,036,262 | 7/1977 | Darsie et al. . | |
| 4,040,451 | 8/1977 | Trost et al. | 139/48 |
| 4,105,052 | 8/1978 | Trost et al. | 139/DIG. 1 X |
| 4,438,173 | 3/1984 | Trost | 428/225 X |
| 4,615,256 | 10/1986 | Fukuta et al. | 139/11 X |
| 4,771,518 | 9/1988 | LaPointe et al. . | |
| 4,938,270 | 7/1990 | Fukuta et al. | 139/457 |

FOREIGN PATENT DOCUMENTS

| | | | |
|---|---|---|---|
| 0113196 | 7/1984 | European Pat. Off. | 87/8 |
| 0271409 | 6/1988 | European Pat. Off. . | |
| 3819708 | 12/1988 | Fed. Rep. of Germany . | |
| 61-49592 | 3/1986 | Japan . | |
| 159546 | 7/1988 | Japan . | |

OTHER PUBLICATIONS

Textile Products Incorporated Sales Brochure.

*Primary Examiner*—Andrew M. Falik

*Attorney, Agent, or Firm*—Oblon, Spivak, McClelland, Maier & Neustadt

[57] ABSTRACT

A triaxial textile fabric for use as a reinforcing textile fabric for a composite material wherein the modulus of elasticity is made isotropic and which can be readily deformed into a three-dimensional configuration without causing special changes in orientation angles and a process by which such a textile fabric can be easily produced. The fabric comprises a large number of oblique yarns extending in a radial direction from the center of the textile fabric, and a circumferential yarn woven spirally in a circumferential direction between the oblique yarns. Each adjacent ones of the oblique yarns are interlaced with each other and the circumferential yarn is woven between the thus interlaced oblique yarns such that such interlacing may appear between each adjacent coils of the spirally woven circumferential yarn. Such an interlacing step takes place after insertion of the circumferential yarn and before an upward and downward movement of the alternate oblique yarns.

4 Claims, 5 Drawing Sheets

TRIAXIAL FABRIC OF INTERLACED OBLIQUE YARNS

This application is a continuation of application Ser. No. 07/278,210, filed on Nov. 30, 1988, now abandoned.

BACKGROUND OF THE INVENTION

1. Field of the Invention

This invention relates to a textile fabric for a three-dimensional shaping which is used principally as a reinforcer of a composite material for a structure having a configuration of a shell body of revolution or the like and also to a process of production of such a textile fabric.

2. Discussion of Background

In a composite material having reinforcing fiber orientation angles of 0 degree and 90 degrees, such characteristics as a coefficient of thermal conductivity and a coefficient of thermal expansion are represented by tensors of second order and the values of the characteristics are made isotropic, but it is known that the modulus of elasticity which is represented by a tensor of fourth order exhibits a remarkable anisotropy. It is theoretically determined that up to three axes of 0 degree and ±60 degrees are required in order to attain an isotropy in modulus of elasticity of a composite material. While it is not always required that the characteristics be isotropic, it is preferable that an arbitrary isotropy from a one directional reinforcer to an isotropic reinforcer can be realized in order to make use of the advantage of a composite material t possible to design characteristics of the mater order to realize the isotropy in modulus of elasticity, a triaxial flat plane fabric having orientation angles of 0 degree and ±60 degrees and an equipment for production of the same have been developed and sold by Barber Colman Co. (U.S. Pat. No. 4,040,451 and U.S. Pat. No. 4,105,052) in addition to fabrics of a plain weave and a satin weave as reinforcers for a composite material for a structure.

Such a flat plane fabric is effective to produce a composite material of a configuration of a curved plane plate having a curved flat surface or a developable surface. However, where it is to be used for a general curved surface, it must be either distorted in orientation axes thereof or a reinforcing fabric must be patched thereto. Accordingly, deterioration in characteristics of the flat plane fabric such as strength, rigidity and accuracy in dimension cannot be avoided. Accordingly, it is desired to directly produce, as a reinforcer for a composite material, a textile fabric having a texture which can be readily deformed into a three-dimensional configuration without causing special changes in three-dimensional configuration or orientation angles. However, while such textile fabrics have been realized with some plain weaves and some knit textures, a triaxial textile fabric having orientation angles of 0 degree and ±60 degrees wherein the modulus of elasticity can be made isotropic has not yet been developed.

Conventionally, such measures are also taken that a suitable number of prepreg sheets each formed by arranging reinforcing fibers in one direction and impregnating the reinforcing fibers with uncured resin material are placed in layers with their orientations displaced by a required angle from each other. However, if the textile fabric thus produced is applied to a curved plane body, then some distortion will appear in orientation angles of the textile fabric, or in some cases, patching may be required, similarly as in the case of the flat plane fabric which is used as a reinforcer described hereinabove.

SUMMARY OF THE INVENTION

Accordingly, it is an object of the present invention to provide a triaxial textile fabric for use as a reinforcing textile fabric for a composite material wherein the modulus of elasticity is made isotropic and which has such a texture as to allow the textile fabric to be readily deformed into a three-dimensional configuration such as a configuration of a curved surface of a body of revolution without causing special changes in orientation angles and to provide a process by which such an improved textile fabric can be produced easily.

In order to attain the object, according to one aspect of the present invention, a textile fabric for three-dimensional shaping comprises a large number of oblique yarns extending in radial directions from the center of the textile fabric, and a circumferential yarn woven spirally in a circumferential direction in the oblique yarns, whereby each adjacent ones of the oblique yarns are interlaced with each other and the circumferential yarn is woven between the thus interlaced oblique yarns such that such interlacing may appear between each adjacent spirally woven circumferential yarn thereby to form the textile fabric as a triaxial textile fabric.

With the textile fabric, since the individual yarns are oriented in a mutually intersecting relationship in triaxial directions, the isotropy of characteristics in a place can be attained. Accordingly, the textile fabric is suitable for a member which received a multi-axial load thereon, and at the same time, it is suitable as a reinforcing textile fabric for a composite material having such a texture as to allow the textile fabric to be readily deformed into a three-dimensional configuration such as configuration of a curved plane of a body of revolution without providing special variations to orientation angles of the textile fabric.

Further, where the individual yarns of the textile fabric are woven in controlled tensions, disorder of the orientation angles is minimized and the fluctuation in yarn density is also minimized. Accordingly, the textile fabric can be utilized effectively as a member which is required to be small in fluctuation of characteristics and be stabilized significantly in characteristics.

According to another aspect of the present invention, a process of producing a textile fabric for three-dimensional shaping comprises a first step of moving first alternate ones of a large number of oblique yarns which extend in radial directions from the center upwardly and the remaining second alternate ones of the oblique yarns downwardly to make an opening between the first and second oblique yarns; a second step of inserting a circumferential yarn into the opening; a third step of moving the first oblique yarns downwardly and the second oblique yarns upwardly to make a reverse opening between the first and second oblique yarns; and a fourth step of inserting the circumferential yarn into the reverse opening are repeated sequentially to weave a fabric with the oblique yarns and the circumferential yarn. The process comprises an additional step of interlacing each adjacent ones of the oblique yarns with each other, the additional step being inserted between the second and third steps and also between the fourth and next first steps, whereby the textile fabric thus woven is a triaxial textile fabric.

According to the process, a triaxial textile fabric having such characteristics as described above can be produced readily.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
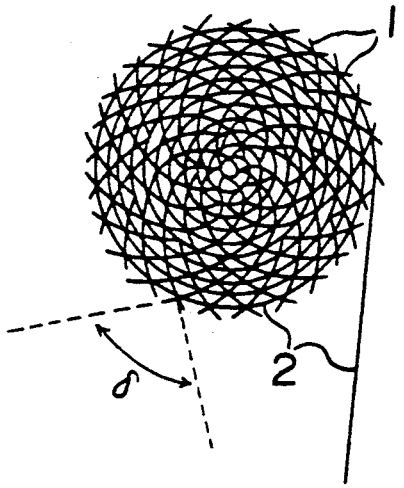
FIG. 1 is a diagrammatic representation illustrating construction of a triaxial textile fabric according to the present invention.

Referring first to FIG. 1, there is shown in diagrammatic representation a triaxial textile fabric for three-dimensional shaping according to the present invention. The triaxial textile fabric shown is used as a reinforcer for a composite material having a three-dimensional configuration such as a shell body of revolution. The triaxial textile fabric is normally made of carbon fibers or glass fibers, but it may otherwise be made of some other various fibers if necessary.

The texture of the triaxial textile fabric is composed of a large number of oblique yarns 1 which extend in radial directions from a central portion of the triaxial textile fabric and each adjacent left and right ones of which are interlaced with each other, and a circumferential yarn 2 which is woven in a circumferential direction in the oblique yarns 1 at each location where adjacent ones of the oblique yarns 1 are interlaced with each other. Thus, the triaxial textile fabric has such a texture that the circumferential yarn 2 is woven spirally into the oblique yarns 1. The intersecting angle of the oblique yarns 1 can be made a stabilized angle within the range of $60 \pm 30$ degrees by a weaving process which will be hereinafter described in detail.

The oblique yarns 1 increase in number substantially in proportion to the radius of a fabric being woven so that the deviation in density of yarns in each increment of the radius of the woven fabric may remain within a predetermined range, and preferably in order that the deviation in yarn density of the oblique yarns ma be normally kept within the range of $\pm 10$ percent, an oblique yarn 1 is added successively in proportion to an increase of the radius of the fabric being woven. Meanwhile, the circumferential yarn 2 is woven spirally into the oblique yarns 1 such that it may present a similar yarn density and a similar deviation in yarn density in the radius increment to those of the oblique yarns. The triaxial textile fabric for a composite material is woven in this manner.

While the triaxial textile fabric can be woven in a shaped configuration such as a configuration of a shell body of revolution in advance, it may otherwise be woven as a flat plane fabric and then shaped into a three-dimensional configuration such as a configuration of a shell body of revolution when it is incorporated into a composite material. Particularly, since the triaxial textile fabric is woven with the oblique yarns and the circumferential yarn, even if it is shaped into a three-dimensional configuration such as a configuration of a shell body of revolution when it is incorporated into a composite material, no specially significant variation will be caused in the yarn density in the radius increment of the same.

Figure 2:
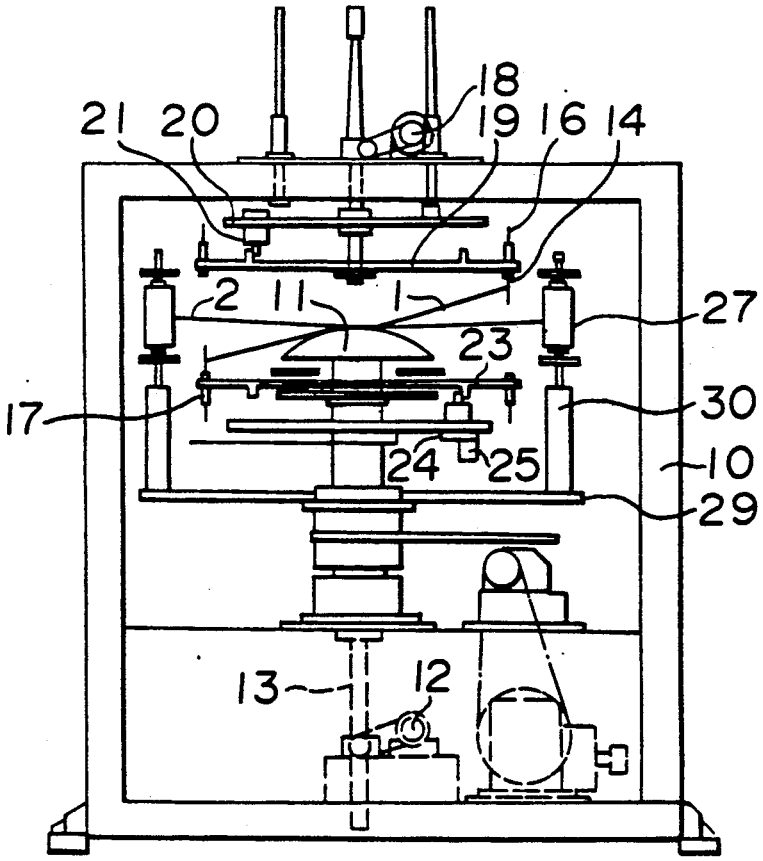
FIG. 2 is a front elevational view of an apparatus for weaving the triaxial textile fabric shown in FIG. 1 as a three-dimensional fabric of a configuration of a shell body of revolution.

Referring now to FIG. 2, there is shown an apparatus for weaving the triaxial textile fabric described above as a three-dimensional fabric of a configuration of a shell body of revolution. The triaxial textile fabric producing apparatus includes a machine frame 10, and a die 11 provided at the center of the machine frame 10 for defining a configuration of a three-dimensional fabric to be woven. The die 11 is moved up and down by means of a lifting shaft 13 which is driven to move up and down by a motor 12.

Oblique yarns 1 are secured at one ends thereof to the center of the die 11 through for example, a stretching weight, see FIG. 1 and column 3, lines 52–60, of U.S. Pat. No. 4,938,270, the subject matter of which is incorporated by reference, and each connected at the other end thereof to shuttle 14 under a fixed tension exerted by a resilient member such as a rubber member or a spring through any means known to one having ordinary skill in the textile art, see for example, the above-mentioned U.S. Pat. No. 4,938,270, the subject matter of which is incorporated by reference, and a triaxial textile fabric is woven with such oblique yarns along a configuration of a surface of the die 11 by operation which will be hereinafter described.

The shuttles 14 mounted at the other ends of the oblique yarns 1 are each grasped alternately by a pair of upper and lower spindle chucks 16 and 17. See for example, FIG. 10 of the above-mentioned U.S. Pat. No. 4,938,270. The upper spindle chucks 16 are mounted along an outer periphery of an upper table 19 which is driven to move up and down by a motor 18 provided on the machine frame 10. The upper table 19 is rotated by a rotationally driving motor 21 mounted on a motor mount 20 which is driven to move up and down together with the upper table 19. Meanwhile, the lower spindle chucks 17 are mounted along an outer periphery of a lower table 23 in a corresponding relationship to the upper spindle chucks 16. The lower table 23 is rotated by another rotational driving motor 25 mounted on a motor mount 24 which is in turn fixedly mounted on the machine frame 10. The individual spindle chucks 16 and 17 are controlled to open or close by a sequencer (not shown) (see for example, FIG. 10 of U.S. Pat. No. 4,938,270), and by downward movement of the upper table 19 and opening and closing movement of the spindle chucks 16 and 17, the shuttles connected to the oblique yarns 1 can be transferred from the upper spindle chucks 16 to the lower spindle chucks 17 or vice versa. Meanwhile, the rotationally driving motors 21 and 25 are controlled by the aforementioned sequencer to move the corresponding positions of the spindle chucks 16 and 17 in a predetermined order in circumferential directions to achieve interlacing of the oblique yarns in accordance with the principle of braiding.

Meanwhile, the circumferential yarn 2 is carried in a wound condition on a bobbin 27 held on a holder 30 at an end of an arm 29 which is turned around the lifting shaft 13 of the die 11 by a motor 28. Accordingly, if an end of the circumferential yarn 2 is positioned between the alternately upwardly and downwardly positioned oblique yarns 1 and the motor 28 is rotated to turn the bobbin 27 around the die 11, the circumferential yarn 2 is inserted into an opening between the oblique yarns. The holder 30 has a tension adjusting mechanism provided therein for permitting adjustment of a tension to be applied to the circumferential yarn 2 led out from the bobbin 27. The tension adjusting mechanism is well known to those in the textile art and an example is illustrated in FIG. 1 of the U.S. Pat. No. 4,938,270. As the tension adjusting mechanism, such a mechanism that includes a member for transmitting a power may be suitably employed. For example, the mechanism may be of a type which utilizes friction, wherein the frictional force between friction members is adjusted in response to an electric signal from the outside, whereby the tensile force of the circumferential yarn 2 is adjusted. As the electric signal, a signal which increases in proportion to the radial distance from the cloth center or fell may be provided in accordance with detected results of the position of the fell of cloth and turning speed of the holder 30. The detecting mechanism being well known to those in the textile art.

With the textile fabric producing apparatus having such a construction as described above, in preparation for weaving, a large number of oblique yarns 1 are secured at one ends thereof to the center of the die 11 and connected at the other ends thereof to the shuttles 14 by way of the resilient members with the tensile forces of the oblique yarns 1 kept substantially fixed, and the individual shuttles 14 are alternately held by the upper and lower spindle chucks 16 and 17.

While the oblique yarns 1 are held in an alternately upwardly and downwardly separated condition by the shuttles 14, the arm 29 is turned by the motor 28 to turn the bobbin 27 around the die 11. During such turning motion of the bobbin 27, the circumferential yarn 2 having the one end held at the center of the die 11 is inserted into the opening between the alternately upwardly and downwardly separated circumferential yarns 1. Subsequently, the shuttles 14 must be transferred between the upper and lower spindle chucks 16 and 17. Such transfer, however, is carried out while the upper and lower spindle chucks 16 and 17 are moved in the opposite circumferential directions by the upper and lower rotationally driving motors 21 and 25, respectively, in such a manner as described below in order to achieve interlacing between each pair of adjacent ones of the oblique yarns 1. A transferring operation itself is performed by driving the motor 18 to move down the upper table 19, transferring the shuttles 14 from the upper spindle chucks 16 to the lower spindle chucks 17 or vice versa, and returning the upper table 19 to its initial position.

FIGS. 3(*a*) to 3(*f*) illustrate the principle of formation of such interlacing as described above, and in FIGS. 3(*a*) to 3(*f*), eleven upper and eleven lower spindle chucks 16 and 17 are illustratively shown by circle marks. In particular, those circles in which symbols A, B, . . . are encircled and shadowed circles represent those spindle chucks which hold shuttles 14 thereon, and blank circles represent those spindle chucks which do not hold shuttles 14 thereon.

Figure 3:
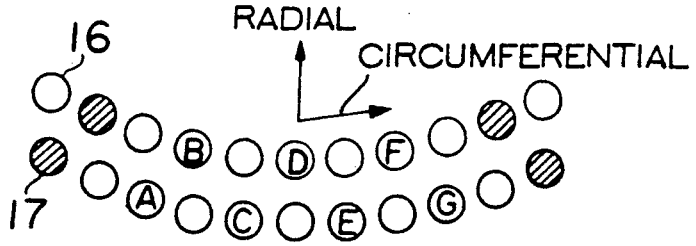
FIGS. 3(*a*) to 3(*f*) are diagrammatic representations illustrating a principle of interlacing of oblique yarns.
Figure 3:
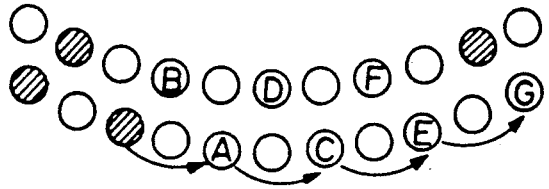
Figure 3:
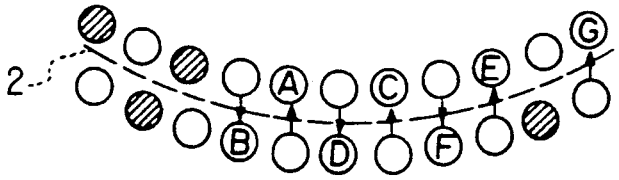
Figure 3:
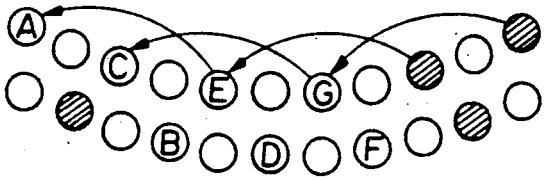
Figure 3:
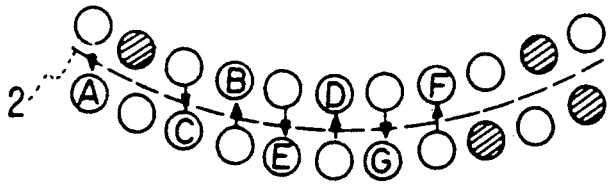
Figure 3:
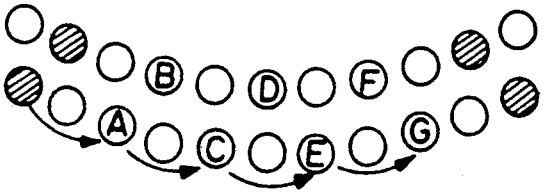

Upon weaving, at first those shuttles 14 which are held on the lower spindle chucks 17 in an initial condition shown in FIG. 3(*a*) are shifted by a distance equal to twice the pitch of the spindle chucks 17 in one circumferential direction to reach such a condition as shown in FIG. 3(*b*). Subsequently, all the shuttles 14 are transferred between the upper and lower spindle chucks 16 and 17 as shown in FIG. 3(*c*), and then the circumferential yarn 2 (FIGS. 3(*c*) and 3(*e*)) is inserted into the opening chucks 16 are shifted by a distance equal to four times the pitch of the spindle chucks 16 in the opposite circumferential direction as shown in FIG. 3(*d*), and then the circumferential yarn 2 is inserted into the opening between the oblique yarns 1 whereafter the oblique yarns 1 are transferred between the upper and lower spindle chucks 16 and 17 as shown in FIG. 3(*e*). After then, the lower spindle chucks 17 are shifted by a distance equal to twice the pitch of the spindle chucks 17 in the one circumferential direction as shown in FIG. 3(*f*) to restore the initial stage shown in FIG. 3(*a*). By such a sequence of operations as described just above, an oblique yarn 1, for example, denoted by A is turned around another oblique yarn 1 denoted by B, and a further oblique yarn 1 denoted at C is turned around the oblique yarn 1 denoted by B. In this manner, each adjacent ones of the oblique yarns 1 are successively interlaced with each other.

Control of the orientation angle $\theta$ of the oblique yarns 1 is effected by displacement of interlaced points of the oblique yarns 1 in radial directions by a tensile force of the circumferential yarn 2, and the angle is determined by a balance in tensile force between the circumferential yarn and the oblique yarns. According to test weaving conducted with a total of 50 oblique yarns, a triaxial textile fabric of an orientation construction of 90 degree and $\pm 60$ degrees was obtained where the radial distance from the cloth center or fell was 100 mm, the tensile force of the circumferential yarn 1200 grams, and the tensile force of the oblique yarns 150 grams. Meanwhile, if the tensile force of the circumferential yarn is raised while the tensile force of the oblique yarns is kept constant at 150 grams, then the included angle $\delta$ between two adjacent oblique yarns increases, but on the contrary if the tensile force of the circumferential yarn is reduced, then the included angle $\delta$ decreases. For example, the angle $\delta$ was $\delta=78$ degrees where the tensile force of the circumferential yarn was 2,000 grams, and the angle $\delta$ was $\delta=47$ degrees where the tensile force was 600 grams.

The triaxial textile fabric produced in this manner is shaped into a configuration conforming to various configurations of the surface of the die 11 by upward and downward movement of the fell of cloth caused by upward and downward movement of the die 11 driven by the motor 12 and by the tensile force of the circumferential yarn 2.

Meanwhile, the yarn densities of the oblique yarns 1 and the circumferential yarn 2 are set by controlling addition of oblique yarns 1 in accordance with the radius of the fell of cloth as well as a resistance against turning motion of the bobbin 27 to adjust the tensile force of the circumferential yarn 2.

To this end, the oblique yarns 1 are prepared in advance by a number required at an outer periphery of a textile fabric to be woven, and the shuttles 14 for the required number of oblique yarns 1 are mounted on the spindle chucks 16 and 17. It is to be noted here that the shuttles 14 are caused to operate for weaving only by a number which increases in proportion to the radius of the fell of cloth while the remaining shuttles 14 are held fixed on the upper chucks 16. Indeed it is possible to leave shuttles 14 for unnecessary oblique yarns on the lower chucks 17, but the unnecessary oblique yarns 1 will have a bad influence on the configuration of a three-dimensional fabric to be woven. Accordingly, the shuttles 14 for such unnecessary oblique yarns 1 are preferably held fixed on the upper chucks 16.

While, in the process of weaving, the number of those spindle chucks which are to perform weaving operation is increased in proportion to the radial distance from the cloth center of fell, the radial distance from the cloth center or fell may be detected in accordance with the number of inserting operations of the circumferential yarn 2 or by means of a detector for detecting the position of the fell of cloth. The number of operative ones of the spindle chucks may thus be increased in accordance with the thus detected radial distance from the cloth center or fell. It is to be noted that there is no necessity of successively changing control of all of the spindle chucks each time the number of operative ones of the chucks is to be increased.

An exemplary weaving process will be described in the following wherein a total of 300 spindle chucks are arranged in three rows each including 100 spindle chucks arranged in an equidistantly spaced relationship along a circle and the number of operative ones of the spindles is increased at 12 stages. In this instance, since the spindle chucks are divided into upper and lower ones at 12 stages, they may be controlled in a total of 24 systems.

Figure 4:
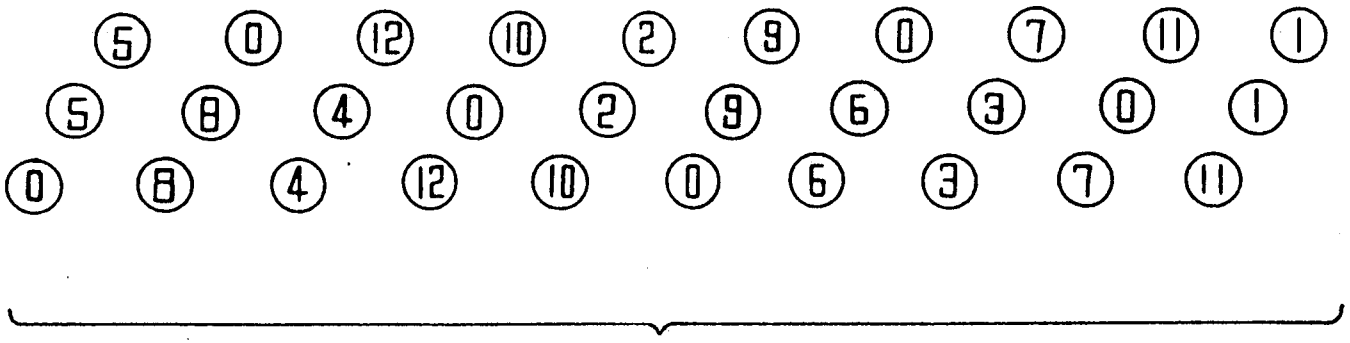
FIG. 4 is a diagrammatic representation illustrating an arrangement of spindle chucks in the apparatus shown in FIG. 2 and a starting order of weaving operation of the spindle chucks.

FIG. 4 illustrates only 30 spindle chucks which are one tenth of the total of 300 spindle chucks described above. The same sequence as the sequence shown in FIG. 4 is provided successively and repetitively on the opposite left and right sides of the sequence shown to complete the spindle chucks on the entire circle defined by the 100 spindle chucks as explained above. While in FIG. 4 the spindle chucks are shown arranged in three rows for convenience, the principle applies similarly to a modified arrangement wherein the spindle chucks are arranged in an equidistantly spaced relationship in a horizontal row. A large number of circles in FIG. 4 denote spindle chucks, and numerical numbers in the circles represent an order of insertion. In particular, at an initial stage, only those spindle chucks denoted by 0 are caused to operate so that only oblique yarns connected to those shuttles on the operative spindle chucks make a weaving movement. Then at a subsequent next stage, two spindle chucks denoted by 1 are additionally put into weaving operation. After then, those spindle chucks denoted by 2, 3, 4, . . . are additionally put into weaving operation successively. In this manner, the number of operative ones of the spindle chucks is increased at 12 stages.

In order to simplify control of operation of the spindle chucks, it is necessary to cause, when the number of oblique yarns is to be increased, a pair of spindle chucks to start weaving operation as seen in FIG. 4. In particular, since each adjacent ones of the oblique yarns have different orientation angles, insertion of an even number of spindle chucks is required in order to increase the number of oblique yarns without disturbing the cycle of the oblique yarns. It is to be noted that, even if an even number of oblique yarns are increased, the distances between adjacent oblique yarns is automatically equalized upon insertion of the circumferential yarn and no significant partial variation will be caused in yarn density.

While the yarn density of the oblique yarns is determined at starting of weaving operation of the spindle chucks as described hereinabove, the tensile force of the circumferential yarn may be increased in proportion to the radial distance from the cloth center or fell in order to make the yarn density of the circumferential yarn uniform. Or more commonly, it has been experimentally confirmed that the ratio between the tensile force of the oblique yarns and the tensile force of the circumferential yarn should be increased in proportion to the radial distance from the cloth center or fell. From the results of an experiment wherein the tensile force of the circumferential yarn was increased at 12 stages together with increase of the number of operative ones of the spindle chucks, it was found out that the fluctuation in yarn density can be restricted to $\pm 7$ percent at the greatest with respect to an aimed value.

If the fluctuation in yarn density of the oblique yarns and the circumferential yarn is restricted within $\pm 10$ percent in this manner, a textile fabric can be obtained which is made significantly uniform in density and also in appearance. This is very effective to improvement of characteristics of a textile fabric particularly of a three-dimensional curved plane also as can be understood from the following description made with reference to FIGS. 5 and 6.

Figure 5:
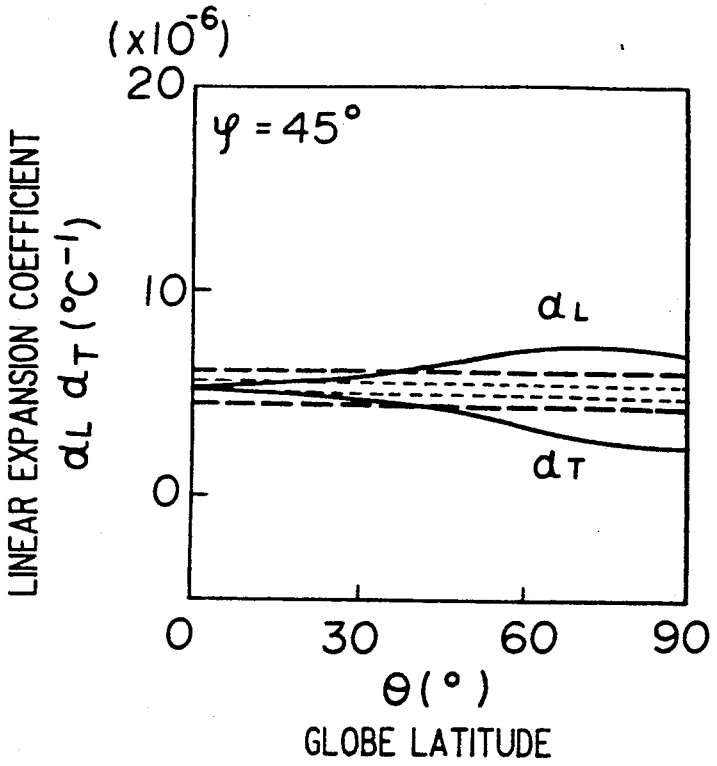
FIGS. 5 and 6 are diagrams illustrating characteristics of a composite material consisting of conventional flat plane fabrics and another composite material consisting of the triaxial textile fabric according to the present invention.
Figure 6:
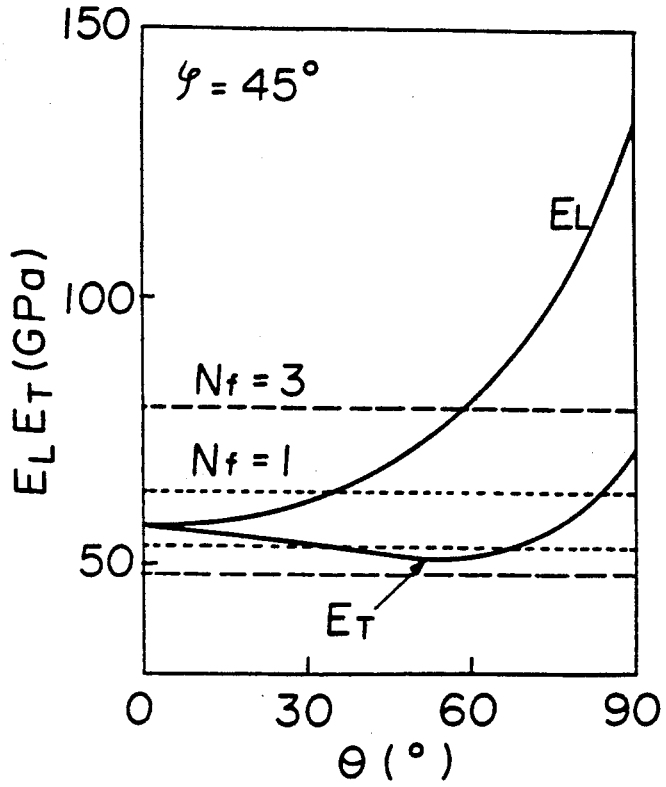

FIGS. 5 and 6 show variations of coefficients of thermal expansion and moduli of elasticity of a composite material consisting of a triaxial textile fabric produced in accordance with the process of the present invention described hereinabove and having a configuration of a three-dimensional curved plane provided by part of a spherical plane and having an orientation angle from the center (refer to FIG. 7) and another composite material which is produced by placing flat plane textile fabrics of a plain weave in layers with orientations thereof displaced by an angle of 45 degrees from each other and then shaping the thus layered flat plane textile fabrics. It has been assumed, in evaluation, that cross points do not move relative to each other and only orientation angles vary in the case of the textile fabrics of a plain weave while in the case of the triaxial curved plane fabric of the embodiment described above the orientations of the oblique and circumferential yarns are not varied and only the deviation in yarn density in the radius increment make a factor of a dispersion in characteristics, and the average fiber content Vf is 50 percent in both cases. In FIGS. 5 and 6, curves $\alpha_L$, $\alpha_T$ and $E_L$, $E_T$ indicate coefficients of thermal expansion and moduli of elasticity in the directions of a line of longitude and a parallel line of latitude where the flat plane fabrics are used, and dotted lines and broken lines indicate variations where increase of oblique yarns is made for each inserting operation and for each three inserting operations, respectively, of a circumferential yarn in the case of the triaxial curved plane textile fabric. The variations shown are results of evaluation on lines of longitude on which they present maximum values.

As can be apparently seen from FIGS. 5 and 6, the composite material which is produced using the three-dimensional fabric of the embodiment described above is superior in characteristics of the coefficient of thermal expansion and the modulus of elasticity to the conventional composite material where the orientation angle $\theta$ is greater than 30 degrees.

For example, in the case of an antenna reflector consisting of part of a spherical plane, a composite material is required wherein the modulus of elasticity is isotropic in a plane and the coefficient of thermal expansion is low and besides the dispersion of the characteristics is small because it is required to have a high configuration maintaining property against an external disturbance and a high structural stability against heat. However, if such a curved plane three-dimensional fabric as described above is employed as a reinforcer for a composite material, such requirements as described above which cannot readily be attained by a conventional composite material can be attained readily by the composite material.

It is to be noted that while the configuration of a three-dimensional fabric produced on the textile fabric producing apparatus shown in FIG. 2 is part of a spherical plane, if the configuration of the die shown in FIG. 2 is suitably selected, then three-dimensional fabrics of configurations of various shell bodies of revolution such as a cone, a parabola and a cylinder can be produced. While in such weaving as described above no beating is required if the tensile force of a circumferential yarn is adjusted suitably, beating may be additionally effected. Such beating could assure production of a three-dimensional fabric wherein the yarn density is controlled with a higher degree of accuracy, or partial beating would permit production of a three-dimensional fabric which has a configuration of a little deformed shell body of revolution.

According to the present invention described in detail above, a triaxial textile fabric can be obtained readily. Besides, since it is possible to control orientation angles of yarns and make the yarn density in the radius increment uniform, if the triaxial textile fabric is used as a reinforcer for a composite material, the composite material thus obtained will have no isotropy in a plane in regard to a modulus of elasticity and a coefficient of thermal expansion. Accordingly, the triaxial textile fabric makes it possible to obtain a composite material which is superior in structural stability against heat and in stability in dimension and has a high rigidity.

Having now fully described the invention, it will be apparent to one of ordinary skill in the art that many changes and modifications can be made thereto without departing from the spirit and scope of the invention as set forth herein.

What is claimed is:

1. A textile fabric for three-dimensional shaping comprising:

a plurality of oblique yarns extending in radial directions from a center of said textile fabric; and a circumferential yarn woven spirally in a circumferential direction in said oblique yarns;

wherein each adjacent one of said oblique yarns are interlaced with each other and said circumferential yarn is woven between the interlaced oblique yarns such that said interlacing occurs between each adjacent spirally woven circumferential yarn to thereby form said textile fabric as a triaxial textile fabric.

2. A textile fabric for three-dimensional shaping according to claim 1, wherein a deviation in yarn density of said oblique yarns and said circumferential yarn is within the range of $\pm 10$ percent.

3. A process for producing a textile fabric for three-dimensional shaping comprising the steps of:

first, moving alternate ones of a plurality of radially extending first oblique yarns which are mounted to a center of a die in an upward direction and moving the remaining second alternate ones of said oblique yarns in a downward direction to make an opening between the first and second oblique yarns;

second, inserting a circumferential yarn into said opening;

third, moving the first oblique yarns in said downward direction and the second oblique yarns in said upward direction to make a reverse opening between said first and second oblique yarns; and fourth, inserting said circumferential yarn into said reverse opening;

wherein said steps are repeated sequentially to weave a fabric with said oblique yarns and said circumferential yarn;

said process comprising the additional step of interlacing each adjacent one of said oblique yarns with each other, said additional step occurring between said second and third steps and said fourth and next first steps whereby said textile fabric thus woven is a triaxial textile fabric.

4. A process of producing a textile fabric for three-dimensional shaping, according to claim 3, wherein the number of said oblique yarns is increased in proportion to the radius of the cloth being woven so that the deviation in yarn density of said oblique yarns normally remains within a fixed range and the ratio between a tensile force of said circumferential yarn and a tensile force of said oblique yarns is increased in proportion to said radius so that the deviation in density of said circumferential yarn remains within a fixed range.

* * * * *

UNITED STATES PATENT AND TRADEMARK OFFICE

CERTIFICATE OF CORRECTION

PATENT NO. : 5,070,914

DATED : December 10, 1991

INVENTOR(S) : KENJI FUKUTA ET AL

It is certified that error appears in the above-identified patent and that said Letters Patent is hereby corrected as shown below:

Please replace Figure 2 as it appears in the patent with the following corrected Figure 2:

FIGURE 2

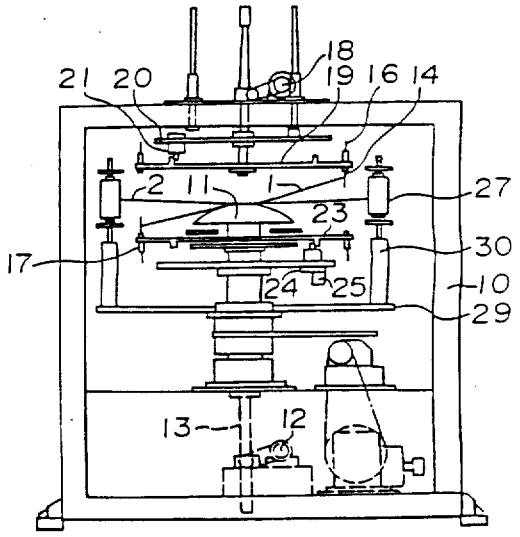

UNITED STATES PATENT AND TRADEMARK OFFICE

CERTIFICATE OF CORRECTION

PATENT NO. : 5,070,914

DATED : December 10, 1991

INVENTOR(S) : KENJI FUKUTA ET AL

Figure 7:
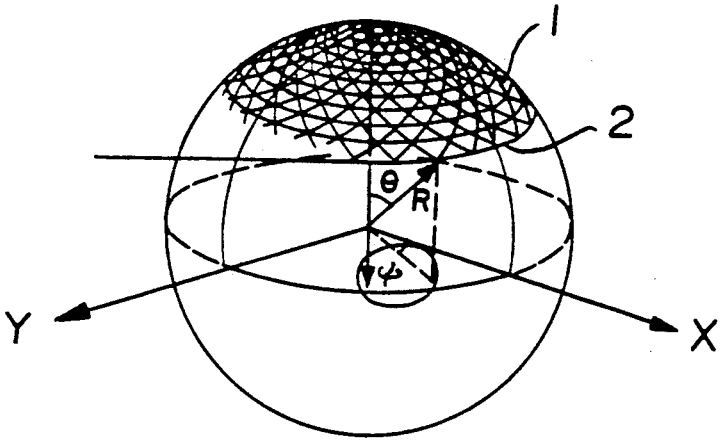
FIG. 7 is a diagrammatic representation illustrating a three-dimensional fabric having such characteristics as shown by dotted lines or broken lines in FIGS. 5 and 6.

It is certified that error appears in the above-identified patent and that said Letters Patent is hereby corrected as shown below:

Please replace Figure 7 as it appears in the patent with the following corrected Figure 7:

FIGURE 7

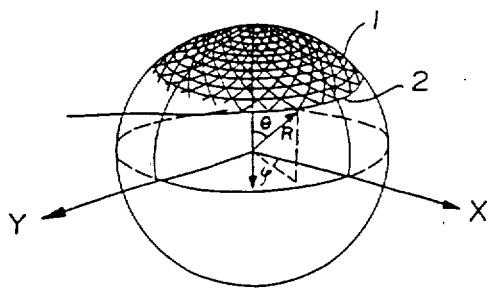

In column 1, line 32, change "material t possible" to --material that it is possible--;

UNITED STATES PATENT AND TRADEMARK OFFICE

CERTIFICATE OF CORRECTION

PATENT NO. : 5,070,914

DATED : December 10, 1991

INVENTOR(S) : KENJI FUKUTA ET AL

It is certified that error appears in the above-identified patent and that said Letters Patent is hereby corrected as shown below:

line 33, change "the mater order to" to --the material. In order to--.

In column 3, line 62, change "ma" to --may--.

Signed and Sealed this

Twenty-fourth Day of August, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,070,914
DATED : December 10, 1991
INVENTOR(S) : Kenji Fukuta, et. al.

It is certified that error appears in the above-indentified patent and that said Letters Patent is hereby corrected as shown below:

Column 6, lines 31-32, change "Control of the orientation angle $\theta$ of the oblique yarns 1" to --Control of the included angle $\delta$ of the oblique yarns 1 shown in FIG. 1--.

Column 9, lines 2 and 3, change "orientation angle $\theta$" to --globe latitude $\theta$--.

Signed and Sealed this
Twenty-sixth Day of April, 1994

*Attest:*

*Attesting Officer*

Bruce Lehman

BRUCE LEHMAN

*Commissioner of Patents and Trademarks*